US012152368B2

(12) United States Patent
Gentle et al.

(10) Patent No.: US 12,152,368 B2
(45) Date of Patent: Nov. 26, 2024

(54) SYSTEMS AND METHODS FOR AUTOMATIC MOLDBOARD POSITIONING

(71) Applicant: Caterpillar Inc., Peoria, IL (US)

(72) Inventors: Michael C. Gentle, Maroa, IL (US); Ethan M. Tevis, Bloomington, IL (US); David L. Cox, Monticello, IL (US)

(73) Assignee: Caterpillar Inc., Peoria, IL (US)

( * ) Notice: Subject to any disclaimer, the term of this patent is extended or adjusted under 35 U.S.C. 154(b) by 827 days.

(21) Appl. No.: 17/356,394

(22) Filed: Jun. 23, 2021

(65) Prior Publication Data

US 2022/0412043 A1 Dec. 29, 2022

(51) Int. Cl.
*E02F 3/84* (2006.01)
*E02F 3/76* (2006.01)

(52) U.S. Cl.
CPC ..... *E02F 3/847* (2013.01); *E02F 3/764* (2013.01); *E02F 3/7645* (2013.01); *E02F 3/765* (2013.01); *E02F 3/7659* (2013.01)

(58) Field of Classification Search
CPC ..... E02F 3/764; E02F 3/7645; E02F 3/765; E02F 3/7659; E02F 3/844; E02F 3/847; E02F 9/0841; E02F 9/205
See application file for complete search history.

(56) References Cited

U.S. PATENT DOCUMENTS 4,077,139 A 3/1978 Fagervold et al.
8,051,587 B2 11/2011 Mills
9,809,956 B1 * 11/2017 Sherlock ..... E02F 3/841
10,370,811 B2 8/2019 May
10,400,425 B2 9/2019 Horstman et al.
10,435,864 B2 * 10/2019 Holman ..... E01H 5/061
10,745,873 B2 8/2020 Kamimae
11,248,362 B2 * 2/2022 Zell ..... E02F 3/844
11,466,426 B2 * 10/2022 Davis ..... F15B 13/0433
11,505,914 B2 * 11/2022 Holman ..... E02F 3/7618
11,572,669 B2 * 2/2023 Harshman ..... E02F 3/845
11,828,041 B2 * 11/2023 Kean ..... E02F 9/264
11,891,782 B2 * 2/2024 Veasy ..... E02F 3/961
2007/0068049 A1 3/2007 Quenzi et al.
2023/0008505 A1 * 1/2023 Gentle ..... E02F 3/764
2023/0257950 A1 * 8/2023 Vahling ..... E02F 3/7659 37/266
2023/0257951 A1 * 8/2023 Kovalick ..... E02F 3/961 37/197
2023/0349118 A1 * 11/2023 Kovalick ..... E01H 5/067

FOREIGN PATENT DOCUMENTS

JP 4448624 B2 1/2003

* cited by examiner

*Primary Examiner* — Gary S Hartmann
(74) *Attorney, Agent, or Firm* — Perkins Coie LLP

(57) ABSTRACT

A computer-implemented method for automatically adjusting a moldboard of a motor grader can include receiving one or more identifiers corresponding to a configuration of the motor grader, and determining, based on the received identifier(s), a first orientation of the moldboard. If the first orientation is not within an operating threshold, the method can further include selecting, based on the one or more identifiers, at least one of a plurality of actuators of the motor grader; and actuating the selected actuator(s) to move the moldboard from the first orientation to a second orientation within the operating threshold.

20 Claims, 11 Drawing Sheets

SYSTEMS AND METHODS FOR AUTOMATIC MOLDBOARD POSITIONING

TECHNICAL FIELD

The present disclosure relates to systems and methods for automatically positioning a moldboard of an industrial machine, including automatically positioning a moldboard of a motor grader relative to a wing of the motor grader.

BACKGROUND

Industrial machines, such as motor graders, are frequently employed to level, smooth, or otherwise at least partially remove materials, such as dirt, gravel, snow, etc., from ground surfaces, such as roads. Some motor graders include a moldboard mounted to a front frame, and a wing mounted to a side of the motor grader. However, it can be difficult for operators to position the moldboard relative to the wing when in operation. In operation, an improperly positioned moldboard can damage the moldboard, the wing, and/or the motor grader.

U.S. Pat. Pub. No. 2007/0068049 A1 to Quenzi (hereinafter "Quenzi") describes a plow assembly including a pair of plow wings which are pivotally mounted at opposite ends of a center plow. In particular, Quenzi describes that each of the plow wings may pivot between a forwardly angled position and an aligned position, and the plow assembly may pivot a trailing plow wing in response to the center plow being urged or angled toward that side of the vehicle. However, Quenzi does not disclose adjusting the center plow based on the position of the plow wings. Additionally, Quenzi does not disclose adjusting the center plow or the plow wings based on operating thresholds.

SUMMARY

In some embodiments, a computer-implemented method for automatically adjusting a moldboard of a motor grader can include receiving one or more identifiers corresponding to a configuration of the motor grader. The motor grader can include a rear frame, a front frame pivotably coupled to the rear frame, and a moldboard assembly coupled to the front frame. The moldboard assembly can include the moldboard, a drawbar, a circle, and a plurality of actuators each operably coupled to at least one of the moldboard, the drawbar, and the circle. The motor grader can further include a wing assembly coupled to the rear frame and to the front frame, and the wing assembly can include a wing. The method can further include determining, based on the one or more identifiers, a first orientation of the moldboard relative to the wing. If the first orientation is not within an operating threshold, the method can include at least one of the following: (i) selecting, based on the one or more identifiers, at least one of the plurality of actuators, and/or (ii) actuating the selected actuator to move the moldboard from the first orientation to a second orientation relative to the wing. In some embodiments, the second orientation of the moldboard can be within the operating threshold.

In some embodiments, a system for automatically adjusting a moldboard of a motor grader can include one or more processors, and one or more memory devices having stored thereon instructions that when executed by the one or more processors cause the one or more processors to perform at least one of the following: (i) receive one or more identifiers corresponding to a configuration of the motor grader; (ii) determine, based on the one or more identifiers, a first orientation of a moldboard of the motor grader relative to a wing of the motor grader; and, if the first orientation is not within an operating threshold; (iii) select, based on the one or more identifiers, at least one of a plurality of actuators of the motor grader; and/or (iv) actuate the selected actuator to move the moldboard from the first orientation to a second orientation relative to the wing, wherein the second orientation is within the operating threshold. In some embodiments, the motor grader can include: (i) a rear frame; (ii) a front frame pivotably coupled to the rear frame; (iii) a moldboard assembly coupled to the front frame and including the moldboard, a drawbar, a circle, and the plurality of actuators, individuals ones of which can be operably coupled to at least one of the moldboard, the drawbar, and the circle; and (iv) a wing assembly coupled to the rear frame and to the front frame, the wing assembly including the wing.

In some embodiments, an apparatus for automatically adjusting a moldboard can include a motor grader and one or more non-transitory computer-readable media. The motor grader can include a rear frame; a front frame pivotably coupled to the rear frame; a moldboard assembly coupled to the front frame and including the moldboard, a drawbar, a circle, and a plurality of actuators, individual ones of which can be operably coupled to at least one of the moldboard, the drawbar, and the circle; a wing assembly coupled to the rear frame and to the front frame and including a wing, and one or more sensors configured to determine a configuration of the motor grader. The one or more non-transitory computer readable media can store computer-executable instructions that, when executed by one or more processors, cause the one or more processors to perform operations including at least one of the following: (i) receive, via a controller communicatively coupled to the one or more sensors, one or more identifiers corresponding to a configuration of the motor grader; (ii) determine, via the controller and based at least in part on the one or more identifiers, a first orientation of the moldboard relative to the wing; and if the first orientation is not within an operating threshold; (iii) select, based on the one or more identifiers, at least one of the plurality of actuators; and/or (iv) actuate the selected actuator to move the moldboard from the first orientation to a second orientation relative to the wing. In the second orientation, the moldboard can be within the operating threshold.

Other aspects will appear hereinafter. The features described herein can be used separately or together, or in various combinations of one or more of them.

BRIEF DESCRIPTION OF THE DRAWINGS

The systems and methods described herein may be better understood by referring to the following Detailed Description in conjunction with the accompanying drawings, in which like reference numerals indicate identical or functionally similar elements:

FIGS. 2B-1 and 2B-2 are schematic illustrations of a machine including a moldboard and a wing in various orientations in accordance with embodiments of the present technology.

FIGS. 2C-1 and 2C-2 are schematic illustrations of a machine including a moldboard and a wing in various orientations in accordance with embodiments of the present technology.

FIGS. 2D-1 and 2D-2 are schematic illustrations of a machine including a moldboard and a wing in various orientations in accordance with embodiments of the present technology.

Figure 1A:
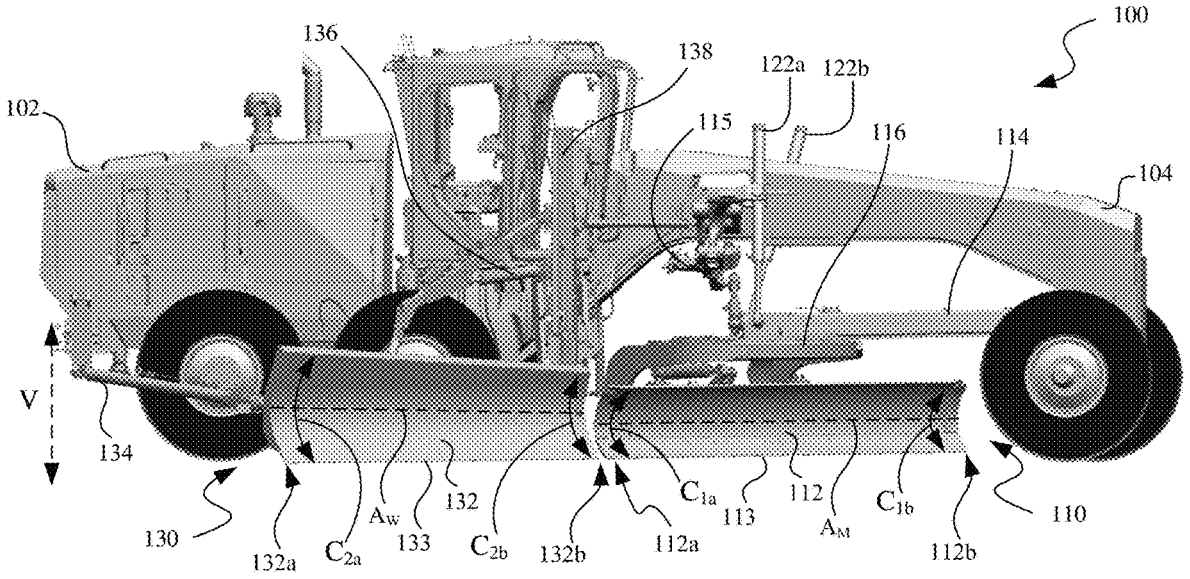
FIG. 1A is a side view of a machine including a first moldboard and a second moldboard in accordance with embodiments of the present technology.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. Rather, the claims are intended to cover all modifications, combinations, equivalents, and alternatives as construed in accordance with this disclosure.

DETAILED DESCRIPTION

Various embodiments of the present technology will now be described in further detail. The following description provides specific details for a thorough understanding and enabling description of these embodiments. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description. Accordingly, embodiments of the present technology may include additional elements or exclude some of the elements described below with reference to the Figures, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such.

FIGS. 1A-1D illustrate various views of a machine 100 configured in accordance with embodiments of the present technology. The machine 100 can be a wheel loader, a front-end loader, a motor grader, a vehicle, an industrial machine, and/or any other suitable machine. The machine 100 can include one or more wing and/or moldboard assemblies. The moldboard assembly(ies) can be configured to at least partially remove one or more materials (e.g., snow, dirt, gravel, sand, etc.) from a surface (e.g., a road, an incline, an embankment, etc.). The moldboard assembly(ies) can be adjustable, e.g., relative to the machine 100 and/or one or more components thereof. In some embodiments, the machine 100 can include a moldboard assembly 110 and a wing assembly 130, and the moldboard assembly 110 can be adjusted or positioned (e.g., automatically adjusted or positioned) to correspond to an orientation of the wing assembly 130. In at least some embodiments, for example, the moldboard assembly 110 can include a moldboard 112, the wing assembly can include a wing 132, and an orientation and/or a position of the moldboard 112 can be adjusted or changed to correspond with or match an orientation of the wing 132.

FIG. 1A is a side view of the machine 100. The machine 100 can include a first or rear frame 102 pivotably coupled to a second or front frame 104. In other embodiments, the coupling can comprise rotatably coupling and/or operably coupling. The moldboard assembly 110 can be coupled (e.g., operably, rotatably, etc.) to the front frame 104. The moldboard assembly 110 can include a moldboard 112 having a first (e.g., right) end portion 112*a*, a second (e.g., left) end portion 112*b*, and a moldboard edge 113 (e.g., a moldboard cutting edge) therebetween. The moldboard edge 113 can be generally or substantially aligned with or parallel to an axis $A_M$ of the moldboard ("the moldboard axis $A_M$"). In some embodiments, the first end portion 112*a* and/or the second end portion 112*b* can each have a profile or contour. In the illustrated embodiment, for example the first end portion 112*a* has a first curvature $C_{1a}$ and the second end portion 112*b* has a second curvature $C_{1b}$. The second curvature $C_{1b}$ can be the same as or different than the first curvature Cia.

The moldboard 112 can be coupled (e.g., operably, rotatably, etc.) to a circle 116. The circle 116 can be coupled (e.g., operably, rotatably, etc.) to a drawbar 114, and the drawbar 114 and/or the circle 116 can be coupled (e.g., operably, rotatably, etc.) to the front frame 104. In some embodiments, the moldboard assembly 110 can further include a linkbar 115 coupled (e.g., operably, rotatably, etc.) to the circle 116 and/or the drawbar 114.

The wing assembly 130 can be coupled (e.g., operably, rotatably, etc.) to the rear frame 102 and/or the front frame 104. The wing assembly 130 can include a wing 132 having a first (e.g., right, heel, trailing, etc.) end portion 132*a*, and second (e.g., left, toe, leading, etc.) end portion 132*b*, and a wing edge 133 (e.g., a wing cutting edge) therebetween. The wing edge 133 can be generally or substantially aligned with or parallel to an axis $A_W$ of the wing ("the wing axis $A_W$"). In some embodiments, the first end portion 132*a* and/or the second end portion 132*b* can each have a profile or contour. In the illustrated embodiment, for example the first end portion 132*a* has a first curvature $C_{2a}$ and the second end portion 132*b* has a second curvature $C_{2b}$. The second curvature $C_{2a}$ can be the same as or different than the first curvature $C_{2b}$.

As best seen in FIG. 1A, the wing assembly 130 can include one or more wing actuators. The wing actuator(s) can be configured to operate independently or in concert to change an orientation of the wing 132 relative to the machine 100 and/or the moldboard 112. In at least some embodiments, for example, the wing assembly 130 can include at least one of the following: (i) wing brace or support actuator 134, (ii) a wing tilt or jib actuator 136, and/or (iii) a wing mast actuator 138. The wing support actuator 134 can be coupled (e.g., operably, etc.) to the rear frame 102, and can be configured to rotate, pivot, or otherwise change the orientation of the wing 132 relative to the machine 100. In some embodiments, this can include changing an angle of the wing 132 (e.g., the wing axis $A_W$) relative to the rear frame 102 and/or to move the first end portion 132*a* in the vertical direction V (e.g., to raise and/or lower the first end portion 132*a*). The wing mast actuator 138 can be coupled (e.g., operably, etc.) to the front frame 104, and can be configured to rotate, pivot, or otherwise change the orientation of the wing 132 relative to the machine 100 to move the second end portion 132*b* in the vertical direction V (e.g., to raise and/or lower the second end portion 132*b*). The wing tilt actuator 136 can be coupled (e.g., operably, etc.) to the wing mast 138, and can be configured to move the first end portion 132*a* of the wing 132 in the vertical direction V (e.g., to raise and/or lower the first end portion 132*a*). The wing tilt actuator 136 and the wing support actuator 134 can operate independently or in combination to move the first end portion 132*a* of the wing 132 in the vertical direction V. Each of the wing actuators can include one or more motors, solenoids, pistons, hydraulics, gears, joints, a combination thereof, and/or any other suitable actuator.

Figure 1B:
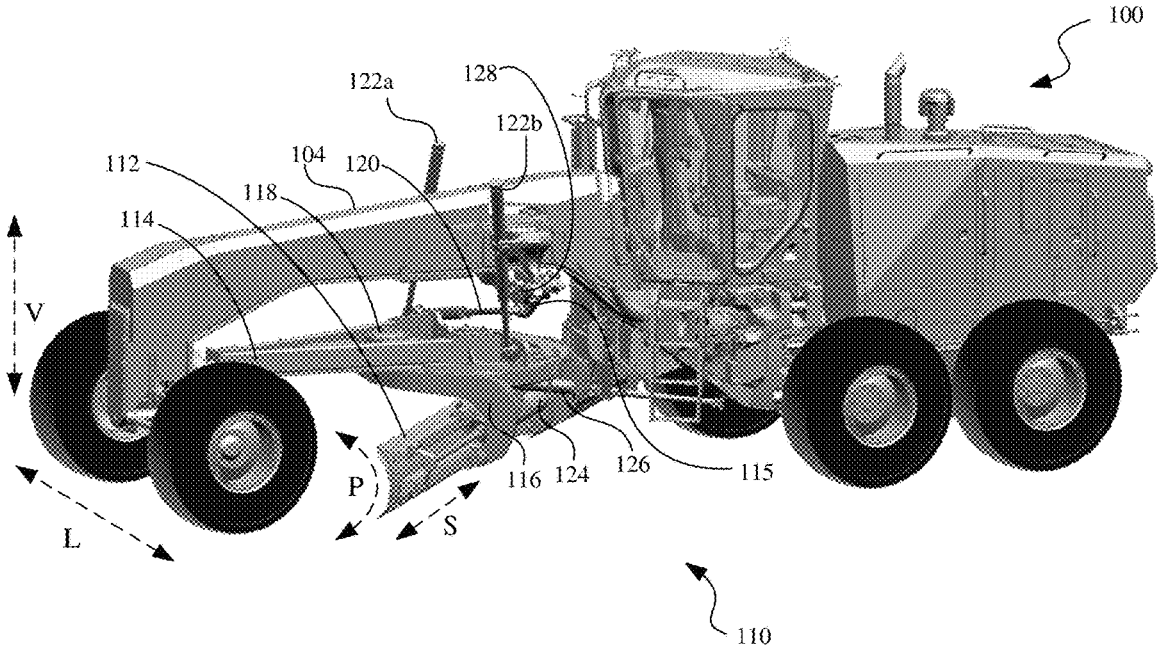
FIG. 1B is a perspective view of the machine of FIG. 1A.

FIG. 1B is a perspective view of the machine of FIG. 1A. As best seen in FIG. 1B, the moldboard assembly 110 can include one or more moldboard actuators. The moldboard actuator(s) can be configured to operate independently or in concert to change an orientation of the moldboard 112 relative to the machine 100 and/or the wing 132. In at least some embodiments, for example, the moldboard assembly 110 can include at least one of the following: (i) a circle rotation motor or actuator 118, (ii) a drawbar lateral or centershift actuator 120, (iii) a first (e.g., right) circle tilt or moldboard lift actuator 122*a*, (iv) a second (e.g., left) circle tilt or moldboard lift actuator 122*b*, (v) a moldboard lateral or sideshift actuator 124, (vi) a moldboard rotational or pitch actuator 126, and/or (vii) a linkbar actuator 128.

The circle rotation actuator 118 can couple (e.g., operably, etc.) the circle 116 and the drawbar 114, and can be configured to rotate the circle 116 and the moldboard 112 relative to the drawbar 114 and/or the front frame 104.

The drawbar centershift actuator 120 can couple (e.g., operably, etc.) the drawbar 114 and the front frame 104, and can be configured to rotate the drawbar 114 relative to the front frame 104 to move the circle 116 and the moldboard 112 in a lateral direction L about a pivot point (not shown) relative to the front frame 104 (e.g., move the circle 116 and the moldboard 112 to the left and/or right of the front frame 104).

The first moldboard lift actuator 122*a* and the second moldboard lift actuator 122*b* (collectively, "the moldboard lift actuators 122") can couple (e.g., operably, etc.) the front frame 104 and the drawbar 114, and can be configured to shift the drawbar 114, the circle 116, and/or the moldboard 112 relative to the front frame 104. In at least some embodiments, for example, and with reference to FIG. 1A, the moldboard lift actuators 122 can work independently or in coordination to move the first end portion 112*a* and/or the second end portion 112*b* of the moldboard in the vertical direction V (e.g., to raise and/or lower the first end portion 112*a* and/or the second portion 112*b*).

The moldboard sideshift actuator 124 can be coupled (e.g., operably, etc.) to the circle 116 and the moldboard 112, and can be configured to move (e.g., shift) the moldboard 112 along the moldboard axis $A_M$ (FIG. 1A) in the direction S (e.g., at least partially in a lateral direction L) relative to the drawbar 114 and/or the front frame 104.

The moldboard pitch actuator 126 can be coupled to the circle 116 and the moldboard 112, and can be configured to rotate or pivot the moldboard about the moldboard axis $A_M$ (FIG. 1A) in the direction P (FIG. 1B) (e.g., to change a pitch of the moldboard 112 relative to the front frame 104).

The linkbar actuator 128 can be coupled (e.g., operably, etc.) to the linkbar 115 and the front frame 104, and can be configured to control the linkbar 115. In at least some embodiments, for example, the linkbar 115 is designed to increase a range of motion of the moldboard 112, e.g., to increase a lateral or horizontal reach of the moldboard 112 from a centerline or longitudinal axis of the machine 100 and/or to allow steeper moldboard angles (e.g., relative to the centerline of the machine and/or a ground surface). The linkbar 115 can include one or more holes or positions that can correspond to an offset of the circle from the front frame 104 center line. Accordingly, actuating the linkbar actuator 128 can reposition the linkbar 115, which can increase the motor grader's productivity, e.g., when ditching, backsloping and/or moving large windrows.

Each of the moldboard actuators can include one or more motors, solenoids, pistons, hydraulics, gears, joints, a combination thereof, and/or any other suitable actuator.

Figure 1C:
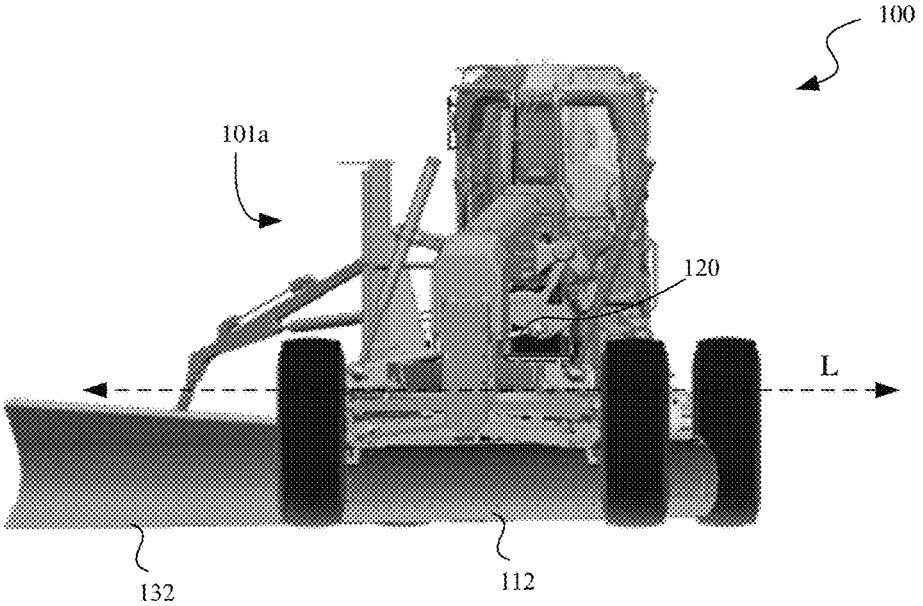
FIG. 1C is a front view of the machine of FIG. 1A.

FIG. 1C is a front view of the machine 100 of FIG. 1A. In some embodiments, one or more of the moldboard actuators can be actuated to move the moldboard 112 relative to the wing 132. In the illustrated embodiment, for example, the drawbar centershift actuator 120 has been actuated to move the moldboard 112 in the lateral direction L to a right side 101*a* of the machine (e.g., towards the wing 132).

Figure 1D:
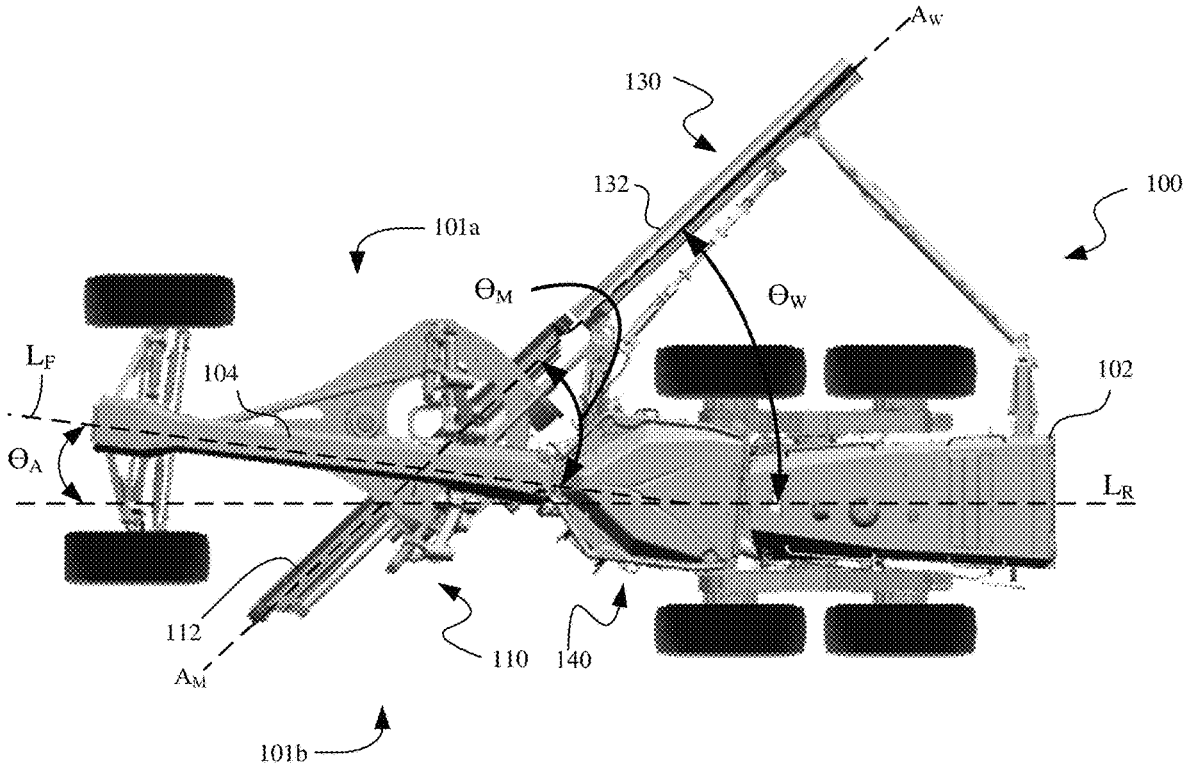
FIG. 1D is a top view of the machine of FIG. 1A

FIG. 1D is a top view of the machine 100 of FIG. 1A. The machine 100 can further include a front frame articulation element or actuator 140. The front frame articulation element 140 can couple (e.g., operably, rotatably, etc.) the front frame 104 and the rear frame 102, and can be actuated to rotate the front frame 104 relative to the rear frame 102. In the illustrated embodiment, for example, the front frame has a first longitudinal axis $L_F$ ("the front frame axis $L_F$"), the rear frame has a second longitudinal axis $L_R$ ("the rear frame axis $L_R$"), and actuating the front frame articulation element 140 can rotate the front frame axis $L_F$ to a front frame angle $\theta_A$ relative to the rear frame axis $L_R$.

As best seen in FIG. 1D, in some embodiments, the moldboard 112 and/or the wing 132 can be angled relative to the machine 100. In the illustrated embodiment, for example, the moldboard 112 (e.g., the moldboard axis $A_M$) is at a first or moldboard angle $\theta_M$ relative to the front frame axis $L_F$, and the wing 132 (e.g., the wing axis $A_W$) is at a second or wing angle $\theta_W$ relative to the rear frame axis $L_R$. In some embodiments, the moldboard angle $\theta_M$ can be determined relative to rear frame axis $L_R$. In some embodiments, the wing angle $\theta_W$ can be fixed or predetermined. In some embodiments, the wing angle $\theta_W$ can be adjusted or changed (e.g., by one or more of the wing actuators), and the moldboard angle $\theta_M$ can be adjusted in response to the wing angle $\theta_W$.

In some embodiments, actuating the front frame articulation element 140 to rotate the front frame 104 (e.g., during operation of the machine 100) can cause a corresponding movement of the moldboard assembly 110 and/or one or more components thereof. This can result in the moldboard 112 being angled, spaced apart from, or otherwise misaligned relative to the wing 132. For example, rotating the front frame 104 can result in a corresponding rotation of the moldboard assembly 110 and/or the moldboard 112. Accordingly, the orientation of the moldboard 112 can be adjusted (e.g., automatically adjusted) in response to the rotation of the front frame 104, e.g., to match an orientation (e.g., position, angle, pitch, etc.) of the wing 132. In the illustrated embodiment, for example, the front frame articulation element 140 has been actuated to rotate the front frame 104 (and the front frame axis $L_F$) relative to the rear frame 102 (and the rear frame axis $L_R$) to the front frame angle $\theta_A$, and, in response, the moldboard 112 has been rotated to the moldboard angle $\theta_M$ (e.g., by actuating the circle rotation actuator 118 to rotate the circle 116) such that the moldboard axis $A_M$ is generally or substantially colinear or otherwise aligned with the wing axis $A_W$.

In at least some embodiments, the machine 100, and/or one or more components thereof (e.g., the moldboard assembly 110, the wing assembly 130, etc.), can include a plurality of sensors (not shown). The sensors can be configured to measure, for example, the position and/or orientation of each of the components of the machine 100 relative to the rear frame 102, the rear frame axis $L_R$, the front frame 104, and/or the front frame axis $L_F$. The sensors can include rotation or angle sensors configured to measure a rotation or angle of a component, position sensors configured to measure a position of a component, actuation sensors configured to measure an extent or degree to which an actuator has been actuated, and/or any other suitable sensors. For example, the front frame 104 can include a first rotation sensor configured to measure the angle $\theta_A$ of the front frame axis $L_F$ relative to the rear frame axis $L_R$, the moldboard assembly 110 can include a second rotation sensor configured to measure the moldboard angle $\theta_M$, and/or the wing assembly 130 can include a third rotation sensor configured to measure the wing angle $\theta_W$. Any of the actuators (e.g., the wing actuators, the moldboard actuators, etc.) described herein can include one or more sensors configured to determine a rotation, position, actuation, and/or orientation of the corresponding components.

In at least some embodiments, one or more dimensions of the machine 100 can be known or predetermined. This can include, for example, a length of the front frame 104, a length of the rear frame 102, a length of the moldboard 112, a length of the wing 132, the wing angle $\theta_W$, etc. Accordingly, the orientation of the moldboard 112, the front frame 104, and/or the wing 132 can be geometrically determined in accordance with known mathematical principles (e.g., automatically determined) based on the plurality of sensors and/or the one or more dimensions of the machine 100.

FIGS. 2A-1-2D-2 (collectively, "FIGS. 2") show schematic illustrations of machines 200*a-d* including moldboards 212 and wings 232 in accordance with embodiments of the present technology. The machines 200*a-d* of FIGS. 2 and/or one or more components thereof can be generally similar to or the same as the machine 100 of FIGS. 1A-1D and/or one or more components thereof. Accordingly, like numbers (e.g., moldboard 212 versus moldboard 112) are used to identify like elements, and a discussion of FIG. 2 will be limited to those features that differ and/or are necessary for context. Additionally, a discussion of FIG. 2 applies equally to the machine 100 of FIGS. 1A-1D.

In some embodiments, the machines 200*a-d* can include one or more operating thresholds T. The operating threshold (s) T can be used to determine whether the orientation of the moldboard 212 needs to be adjusted (e.g., based on the orientation of the wing 232). In at least some embodiments, for example, adjusting the moldboard 212 can include moving the moldboard 212 from a first orientation wherein at least a portion of the moldboard 212 is outside (e.g., beyond, not within, etc.) the operating threshold T to a second orientation wherein that portion is within the operating threshold T. Accordingly, as used herein, the moldboard 112 and/or the moldboard axis $A_M$ can be generally or substantially colinear or otherwise aligned with (e.g., matching) the wing 132 and/or the wing axis $A_W$ in the second orientation.

The operating threshold T can include a distance, a linear distance, an arc length, an angle, and/or any other suitable measurement. The operating threshold T can be defined relative to any component of the machine 100, such as the wing 132, the wing axis $A_W$, the second end portion 132*b* of the wing 132, the wing edge 133, the rear frame 102, the rear frame axis $L_R$, the front frame 104, the front frame axis $L_F$, etc. In at least some embodiments, for example, the operating threshold T can be an angle relative to the wing axis $A_W$ of up to 1 degree, 2 degrees, 3 degrees, 4 degrees, 5 degrees, 10 degrees, 20 degrees, or any angle therebetween. In at least some embodiments, for example, the operating threshold T can be a distance from the second end portion 132*b* of the wing 132 of up to 1 mm, 2 mm, 3 mm, 4 mm, 5 mm, 10 mm, 20 mm, 30 mm, 40 mm, 50 mm, 100 mm, 200 mm, 300 mm, 400 mm, 500 mm, or any distance therebetween.

Figures 1, 2A:
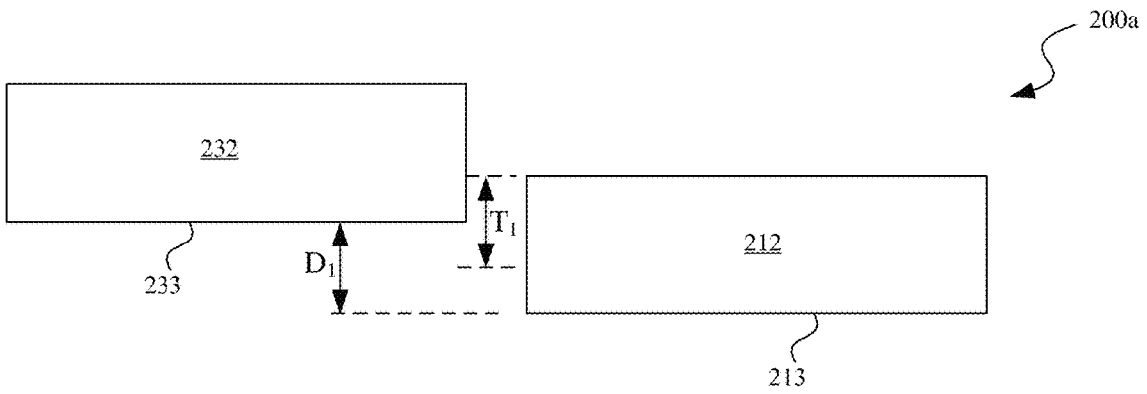
FIGS. 2A-1 and 2A-2 are schematic illustrations of a machine including a moldboard and a wing in various orientations in accordance with embodiments of the present technology.

Referring first to FIG. 2A-1, a schematic front view of a machine 200*a* including a moldboard 212 and a wing 232, in the illustrated embodiment, the moldboard 212 is in a first orientation where the moldboard edge 213 is a distance $D_1$ from the wing edge 233, such that the moldboard edge 213 is not within an operating threshold $T_1$ of the wing edge 233. The distance $D_1$ can be determined (e.g., automatically determined), based on the one or more sensors described previously and with reference to FIGS. 1A-1D.

Figures 2, 2A:
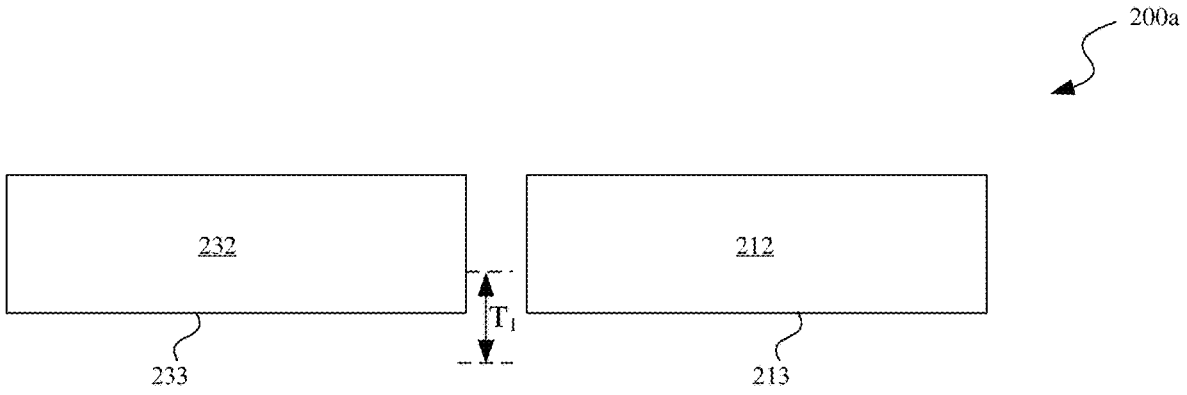

Like FIG. 2A-1, FIG. 2A-2 is a schematic front view of a machine 200*a* including a moldboard 212 and a wing 232. Referring first to FIG. 2A-2, the moldboard 212 has been moved or transitioned from the orientation of FIG. 2A-1 to a second orientation such that the moldboard edge 213 is within the operating threshold $T_1$. In some embodiments, moving the moldboard 212 from the first orientation (FIG. 2A-1) to the second orientation (FIG. 2A-2) can include actuating one or more of the moldboard actuators, such as the first moldboard lift actuator 122*a* (FIG. 1B) and/or the second moldboard lift actuator 122*b* (FIG. 1B) (e.g., to move the moldboard 212 relative to the wing 232).

Figures 1, 2B:
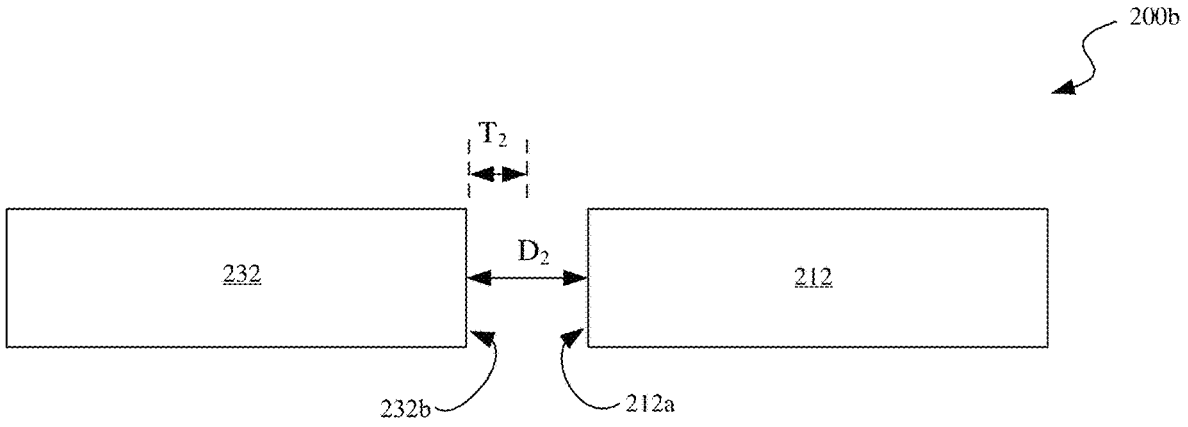
Figures 2, 2B:
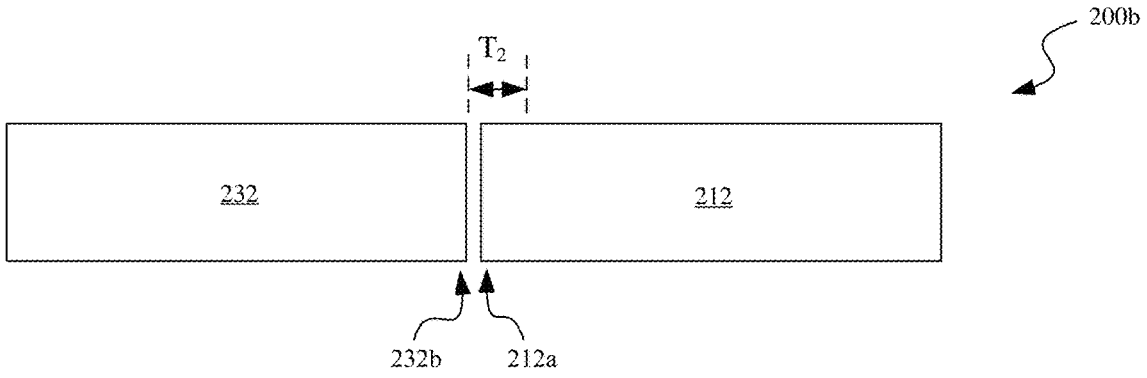

FIGS. 2B-1 and 2B-2 are schematic front views of a machine 200*b*, including a moldboard 212 and a wing 232. Referring first to FIG. 2B-1, in the illustrated embodiment, the moldboard 212 is in a first orientation where the first end portion 212*a* is a distance $D_2$ from the second end portion 232*b* of the wing 232, such that the first end portion 212*a* is not within an operating threshold $T_2$ of the second end portion 232*b*. The distance $D_2$ can be determined (e.g., automatically determined), based on the one or more sensors described previously and with reference to FIGS. 1A-1D.

Referring next to FIG. 2B-2, the moldboard 212 has been moved to a second orientation such that the first end portion 212*a* is within the operating threshold $T_2$. Moving the moldboard 212 from the first orientation (FIG. 2B-1) to the second orientation (FIG. 2B-2) can include actuating one or more of the moldboard actuators, such as the circle rotation actuator 118 (FIG. 1B), the drawbar centershift actuator 120 (FIG. 1B), the moldboard sideshift actuator 124, and/or the front frame articulation element 140 (FIG. 1D) (e.g., to move the moldboard 212 relative to the wing 232).

Figures 1, 2C:
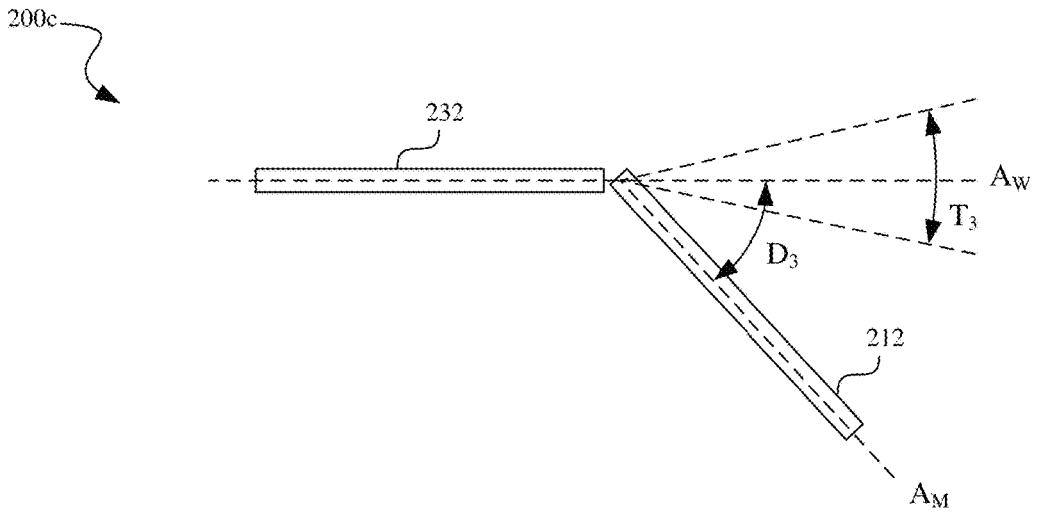
Figures 2, 2C:
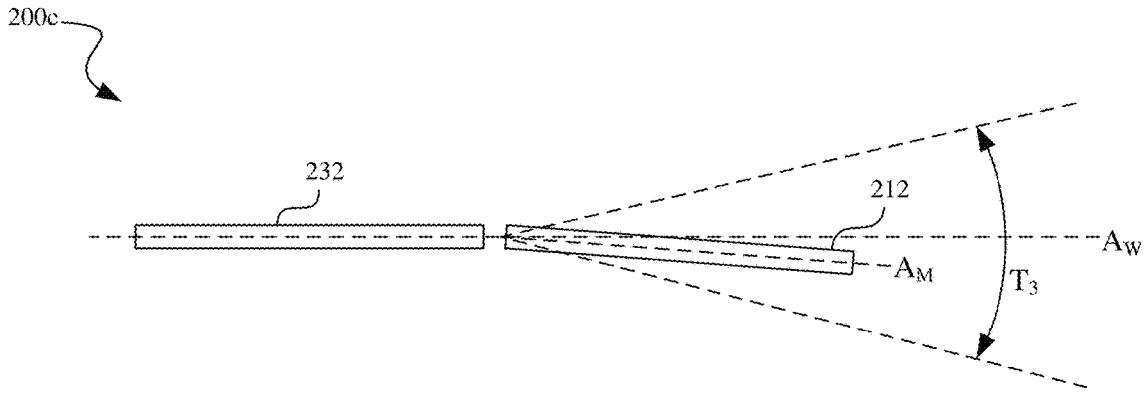

FIGS. 2C-1 and 2C-2 are schematic top views of a machine 200*c*, including a moldboard 212 and a wing 232. Referring first to FIG. 2C-1, in the illustrated embodiment, the moldboard 212 is in a first orientation where the moldboard axis $A_M$ is at an angle $D_3$ relative to the wing axis $A_W$, such that the moldboard 212 is not within an operating threshold $T_3$ of the wing 232. The angle $D_3$ can be determined (e.g., automatically determined), based on the one or more sensors described previously and with reference to FIGS. 1A-1D.

Referring next to FIG. 2C-2, the moldboard 212 has been moved to a second orientation such that the moldboard 212 and/or moldboard axis $A_M$ are within the operating threshold $T_3$ of the wing 232 and/or wing axis $A_W$. Moving the moldboard 212 from the first orientation (FIG. 2C-1) to the second orientation (FIG. 2C-2) can include actuating one or more of the moldboard actuators, such as the circle rotation actuator 118 (FIG. 1B), the drawbar centershift actuator 120 (FIG. 1B), and/or the front frame articulation element 140 (FIG. 1D) (e.g., to rotate the moldboard 212 relative to the wing 232).

Figures 1, 2D:
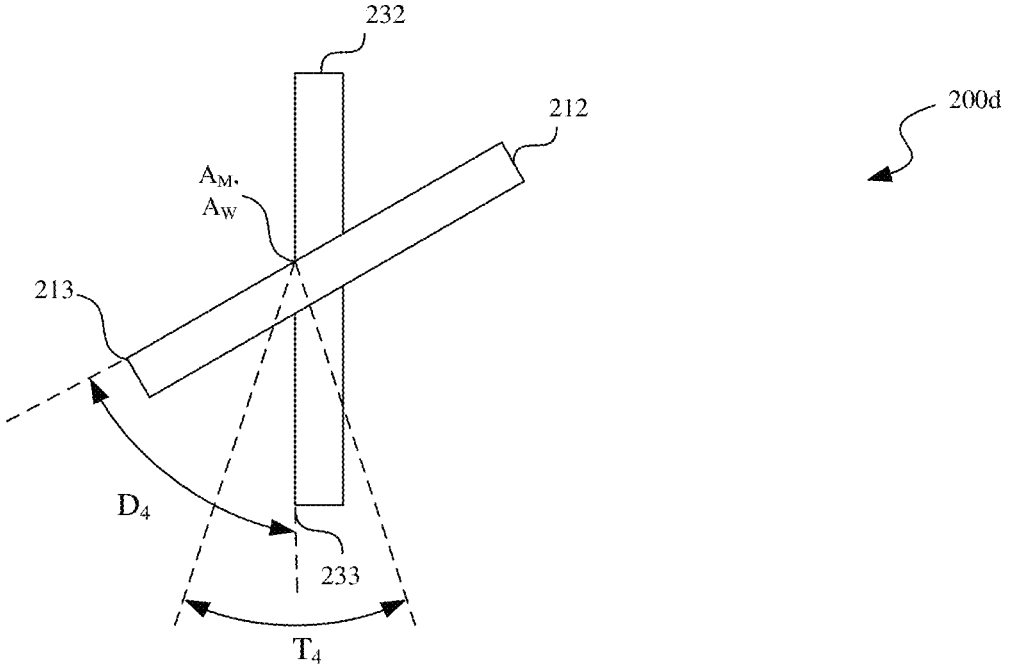
Figures 2, 2D:
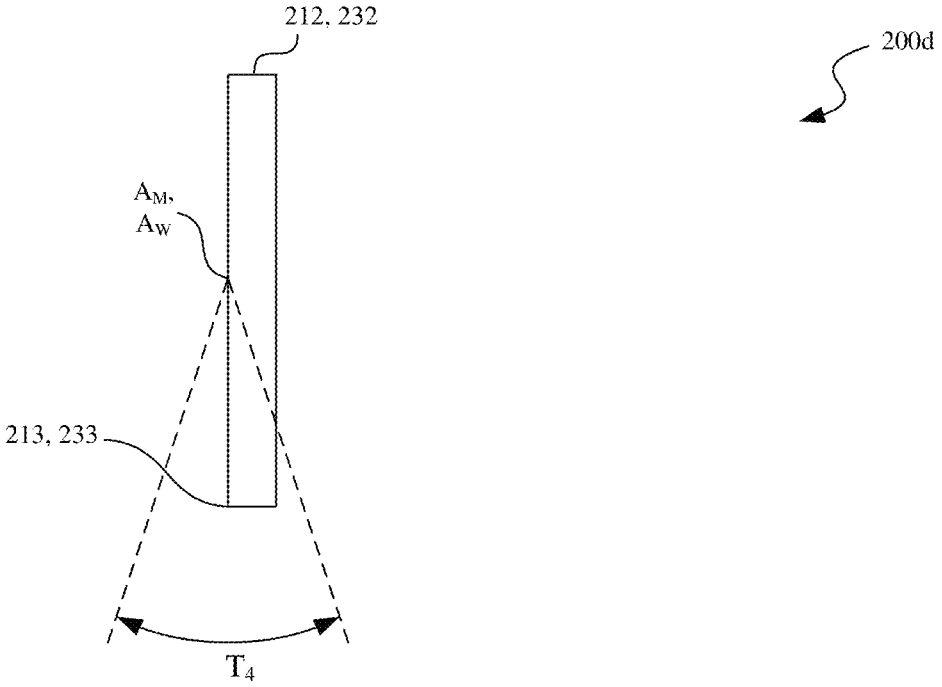

FIGS. 2D-1 and 2D-2 are schematic side views of a machine 200*d*, including a moldboard 212 and a wing 232. Referring first to FIG. 2D-1, in the illustrated embodiment, the moldboard 212 is in a first orientation wherein the moldboard axis $A_M$ is aligned (e.g., colinear) with the wing axis $A_W$, but, relative to the moldboard axis $A_M$ and/or the wing axis $A_W$, the moldboard edge 213 is pitched at an angle $D_4$ to the wing edge 233 such that the moldboard edge 213 is not within an operating threshold $T_4$. The angle $D_4$ can be determined (e.g., automatically determined), based on the one or more sensors described previously and with reference to FIGS. 1A-1D.

Referring next to FIG. 2D-2, the moldboard 212 has been moved to a second orientation such that the moldboard edge 213 is within the operating threshold $T_4$. Moving the moldboard 212 from the first orientation (FIG. 2D-1) to the second orientation (FIG. 2D-2) can include actuating one or more of the moldboard actuators, such as the moldboard pitch actuator 126 (FIG. 1B) (e.g., to rotate the moldboard 212 about the moldboard axis AM).

Although FIG. 2 are described in the context of adjusting the moldboard 212 based on the wing 232, in other embodiments, the wing 232 can be adjusted based on the moldboard 212. In at least some embodiments, for example, the wing 232 can moved from a first orientation where the wing axis $A_W$ is outside/not within an operating threshold of the moldboard axis $A_M$ to a second orientation where the wing axis is within the operating threshold (e.g., by actuating one or more of the wing actuators described previously). Additionally, in some embodiments the moldboard 212 and the wing 232 can be adjusted in concert (e.g., jointly, together, in coordination, etc.) from a first configuration, where the respective first orientations of the moldboard 212 and the wing 232 are outside one or more operating thresholds T, to a second configuration where the respective orientations of the moldboard 212 and the wing 232 are within at least one of the operating threshold(s) T. Additionally, although the moldboard 212 and wing 232 are illustrated schematically as being rectangular in FIGS. 2, in other embodiments the moldboard 212 and/or the wing 232 can be curved or arcuate, e.g., such that the moldboard 212 and/or the wing 232 can be generally similar to or the same as the respective moldboard 112 and wing 132 of FIGS. 1A-1D.

In some embodiments, the moldboard 212 can be adjusted in response to one or more adjustments to the wing 232. In at least some embodiments, for example, the wing 232 can be moved from a first orientation to a second orientation, and, in response, the moldboard 212 can be moved from a third orientation to a fourth orientation where, in the third orientation, the moldboard 212 is outside the operating threshold T, and where, in the fourth orientation, the moldboard 212 is within the operating threshold T.

Figure 3:
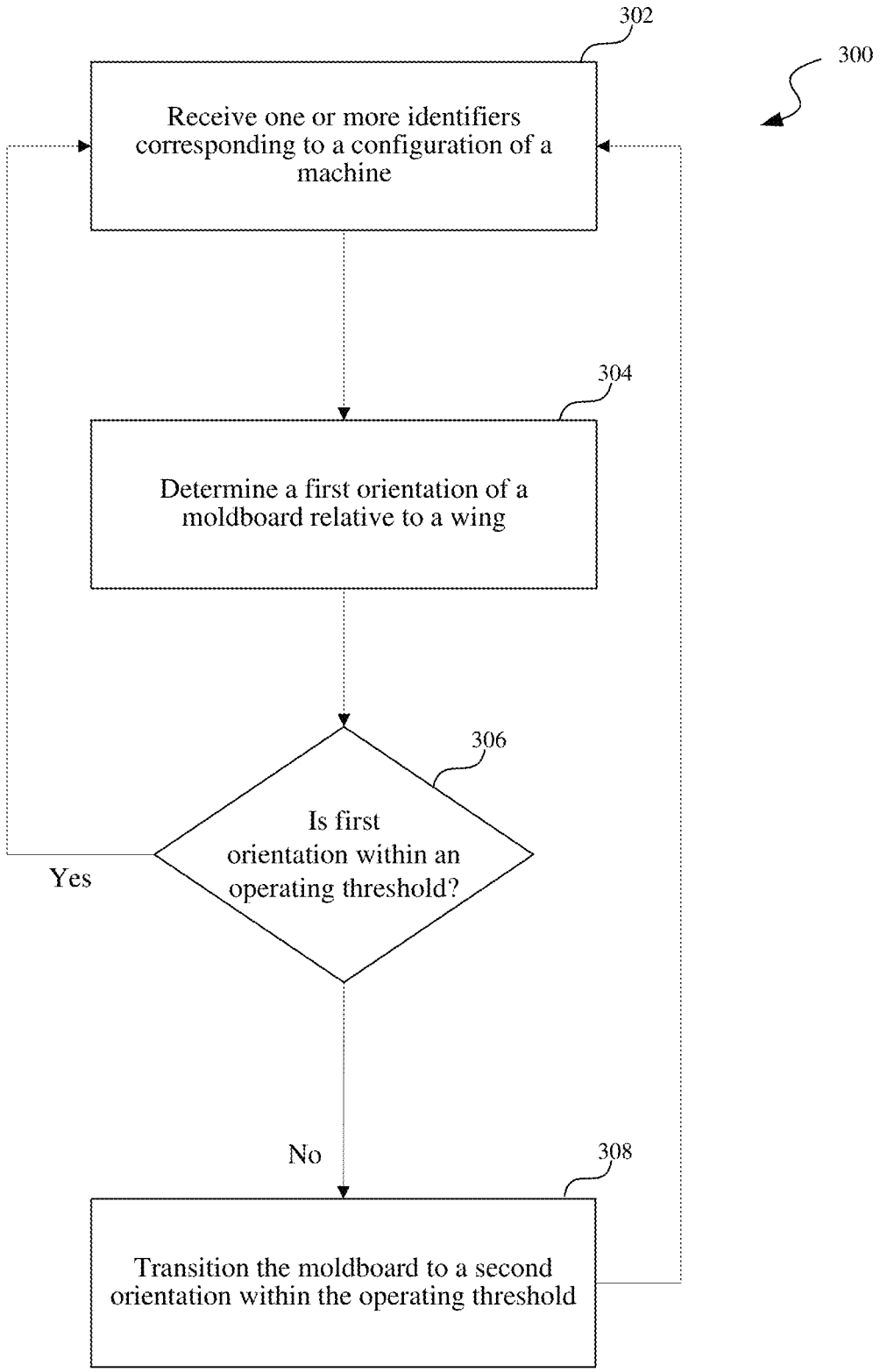
FIG. 3 is a flow diagram illustrating a method for automatically adjusting an orientation of a moldboard in accordance with embodiments of the present technology.

FIG. 3 is a flow diagram illustrating a method 300 (e.g., a computer-implemented method) for automatically adjusting an orientation of a moldboard in accordance with embodiments of the present technology. At step 302, the method 300 includes receiving one or more identifiers corresponding to a configuration of a machine. The machine can be generally similar to or the same as the machine 100 of FIG. 1 and/or the machines 200*a-d* of FIG. 2. The configuration of the machine can comprise one or more dimensions of the machine and/or the output of the one or more sensors, as described previously and with reference to FIGS. 1A-2D-2. For example, in a first configuration of the machine, the front frame axis $L_F$ (FIGS. 1A-D) can be at a first angle relative to the rear frame axis $L_R$ (FIGS. 1A-1D), and the machine can be transitioned to a second configuration where the front frame axis $L_F$ is at a second angle relative to the rear frame axis $L_R$ (e.g., by actuating the front frame articulation element 140 to rotate the front frame 104 relative to the rear frame 102). In at least some embodiments, for example, the one or more identifiers can include a blade sideshift identifier, a left blade lift identifier, a right blade lift identifier, a circle rotation identifier, a drawbar centershift identifier, a linkbar position identifier, a frame articulation identifier, a wing orientation identifier, and/or a machine mode identifier.

The moldboard sideshift identifier can correspond to the orientation and/or movement of the moldboard 112 in the direction S along the moldboard axis $A_M$ (FIGS. 1A and 1B) (e.g., in response to actuating the moldboard sideshift actuator 124).

The left moldboard lift identifier can correspond to the orientation and/or movement of the second end portion 112*b* of the moldboard 112 in the vertical direction V (FIGS. 1A and 1B) (e.g., in response to actuating the second moldboard lift actuator 122*b*).

The right moldboard lift identifier can correspond to the movement of the first end portion 112*a* of the moldboard 112 in the vertical direction V (FIGS. 1A and 1B) (e.g., in response to actuating the first moldboard lift actuator 122*a*).

The circle rotation identifier can correspond to the angle or rotation of the circle 116 and moldboard 112 (e.g., the moldboard angle $\theta_M$) relative to the drawbar 114 and/or the front frame 104 (e.g., in response to actuating the circle rotation actuator 118).

The drawbar centershift identifier can correspond to an angle or rotation of the drawbar 114 relative to the front frame 104 and/or the front frame axis $L_F$ (e.g., in response to actuating the drawbar centershift actuator 120).

The linkbar position identifier can correspond to a configuration of the linkbar 115 (e.g., in response to the linkbar actuator 128). In at least some embodiments, for example, the linkbar position identifier can correspond to the one or more holes or positions of the linkbar 115. In some embodiments, the linkbar position identifier can be defined relative to a reference or center hole of the linkbar 115 (e.g., first hole left of center hole, third hole right of center hole, etc.).

The frame articulation identifier can correspond to the angle $\theta_A$ of the front frame axis $L_F$ relative to the rear frame axis $L_R$ (e.g., in response to actuating the front frame articulation element 140).

The wing orientation identifier can correspond to the orientation of the wing 132 and/or the wing assembly 130. This can include, for example, the wing angle $\theta_W$, movement of the second end portion 132*b* in the vertical direction V (FIG. 1A), and/or rotation of the wing 132 about the wing axis $A_W$.

The machine mode identifier can correspond to a mode of the machine. In at least some embodiments, the machine can have one or more operating modes, and the method 300 can include adjusting the moldboard and/or the wing based on the one or more operating modes. In at least some embodiments, for example, the machine can include one or more of the following operating modes: (i) an off mode; (ii) an auto (active) mode; (iii) an auto (once) mode; and/or (iv) a suspend mode. In the off mode, the machine 100 can be configured to not adjust the position and/or orientation of the moldboard 112. In the auto (active) mode, the machine 100 can be configured to regularly or periodically adjust the position and/or orientation of the moldboard 112 relative to the wing 132. In the auto (once) mode, the machine 100 can be configured to adjust the position and/or orientation of the moldboard 112 relative to the wing 132 one time (e.g., once), but to not perform any further adjustments unless an additional input prompting further adjustments is received. In the suspend mode, the machine 100 can temporarily stop or suspend automatic repositioning of the moldboard. For example, in some embodiments, the wing assembly 130 can be transitioned to a "stowed" position where the wing 132 is rotated such that the wing axis $A_W$ is generally or substantially vertical (e.g., aligned with the vertical direction V). For example, in some embodiments, the wing assembly 130 can be transitioned to a "bench" position where the wing edge 133 remains parallel to a ground surface (e.g., a road, etc.) but the wing 132 is moved or elevated away from the surface. The suspend mode can be activated automatically, e.g., based on the identifiers corresponding to the position and/or configuration of the wing 132, or manually, e.g., by an operator. Accordingly, if one of the one or more identifiers in step 302 corresponds to the "Off" or "suspend" mode, the method 300 can include pausing or remaining at step 302 until an identifier corresponding to the "auto (active)" or "auto (once)" mode is received.

In some embodiments, the one or more identifiers can further include one or more dimensional identifiers. The dimensional identifier(s) can correspond to any of the measurements or dimensions of the machine described previously, such as the arm length identifier that corresponds to the arm length and/or a blade length identifier that corresponds to the blade length. In some embodiments, the one or more identifiers can further include one or more operating threshold identifiers. The operating threshold identifier(s) can correspond to the operating threshold(s) T. In some embodiments, the one or more identifiers can further include a front frame axis identifier. The front frame axis identifier can correspond to the front frame axis $L_F$ of FIGS. 1A-D. In some embodiments, the one or more identifiers can further include a rear frame axis identifier. The rear frame axis identifier can correspond to the rear frame axis $L_R$ of FIGS. 1A-1D.

In some embodiments, at least one of the one or more identifiers can be predetermined (e.g., pre-programmed) based on the configuration of the machine. This can include at least one of the dimensional identifiers, the operating threshold identifier, the front frame axis identifier, the rear frame longitudinal axis identifier, and/or any other identifier described herein. In at least some embodiments, for example, the dimensional identifier(s) can be stored in a database, and step 302 can include accessing the database to determine the dimensional identifier(s).

At step 304, the method 300 can further include determining a first orientation of a moldboard relative to a wing. The first orientation can include one or more distances, linear distances, arc lengths, angles, etc. In some embodiments, the first orientation can be determined (e.g., automatically determined) based on the one or more identifiers of step 302. In at least some embodiments, for example, the one or more identifiers of step 302 can include the wing orientation identifier (corresponding to the wing angle $\theta_W$), the circle rotation identifier (corresponding to the moldboard angle $\theta_M$), the frame articulation identifier (corresponding to the front frame angle $\theta_A$), and one or more dimensional identifiers (e.g., corresponding to the length of the front frame, the moldboard, and/or the wing), and the wing orientation identifier, the circle rotation identifier, the frame articulation identifier, and the one or more dimensional identifiers can be used to determine the first orientation of the moldboard.

At step 306, the method 300 can further include determining whether the first orientation of step 304 is within the operating threshold. If the first orientation is within the operating threshold, then the method 300 can return to step 302, and can further include repeating one or more of the steps 302, 304, and/or 306. If the first orientation is outside (e.g., beyond, not within, etc.) the operating threshold, then the method can continue to step 308. In some embodiments, the operating threshold in step 306 can correspond to one or more operating threshold identifiers received in step 302, and step 306 can include comparing the operating threshold identifier(s) to the determined first orientation of step 304. This is described in greater detail previously and with reference to FIG. 2.

At step 308, the method 300 can further include transitioning the moldboard to a second orientation within the operating threshold of step 306. In some embodiments, transitioning the moldboard can include moving and/or rotating the moldboard relative to the wing and/or a front frame of the machine. In some embodiments, step 308 can include selecting at least one actuator of the moldboard actuator(s) and/or the wing actuator(s) based on the one or more identifiers of step 302. Selecting actuators is described previously and with reference to FIG. 2. The selected actuator(s) can correspond to a distance and/or angle between the moldboard and the wing, and/or one between one or more components of the moldboard and one or more components of the wing. In some embodiments, step 308 can include actuating the selected actuator(s) to transition the moldboard from the first orientation to the second orientation, e.g., as described previously and with reference to FIG. 2.

In some embodiments, once the moldboard is in the second orientation, the method 300 can further include returning to step 302 and repeating one or more of the steps 302, 304, 306, and/or 308.

Figure 4:
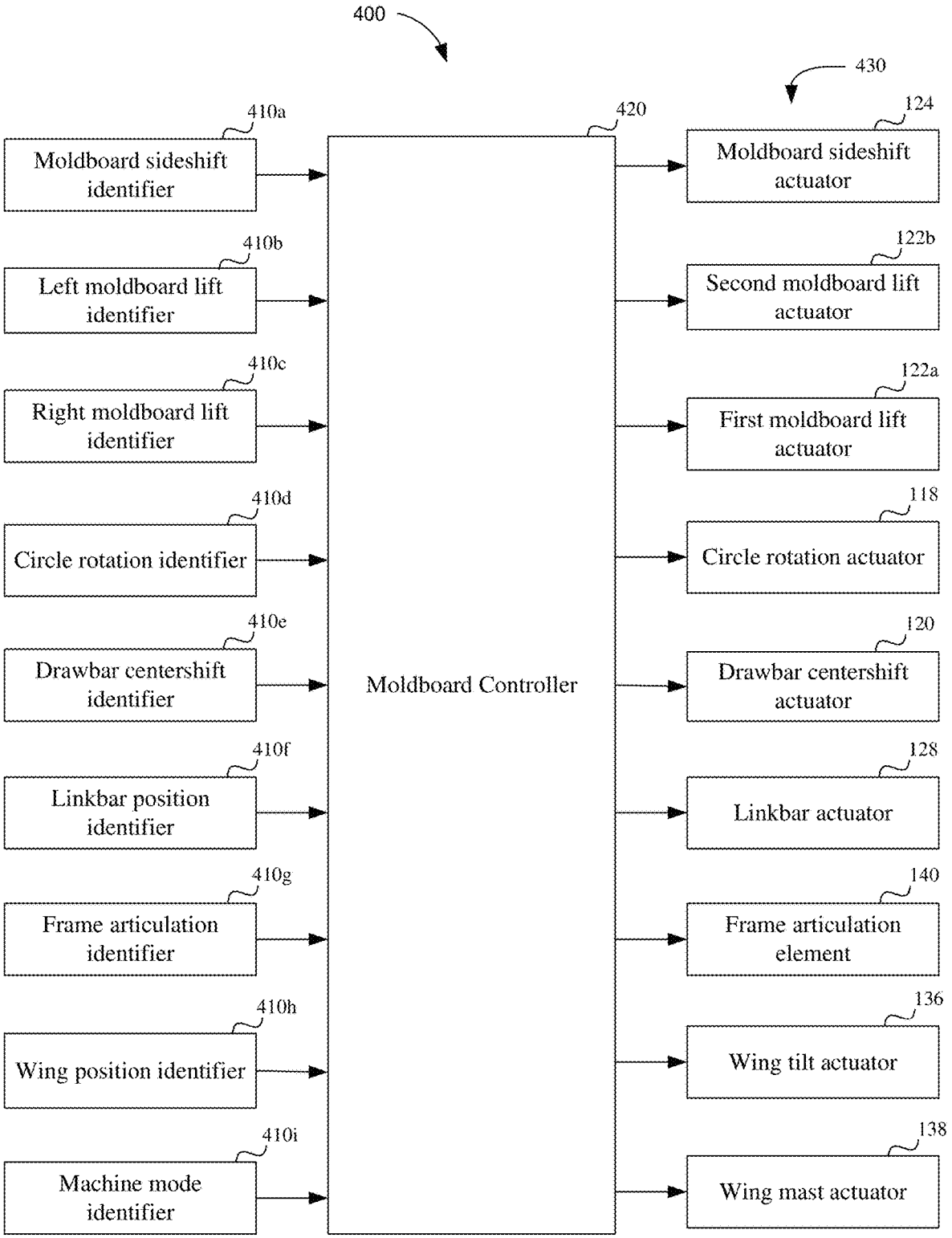
FIG. 4 is a block diagram illustrating a system in accordance with embodiments of the present technology.

FIG. 4 is a block diagram illustrating a system 400 configured to automatically adjust an orientation of a moldboard in accordance with embodiments of the present technology. In some embodiments, the system 400 can be part of the machine 100 of FIGS. 1A-1D, and/or can be configured to adjust the orientation of a moldboard, e.g., to correspond with or match an orientation of a wing. The system 400 can be configured to receive one or more inputs 410 from the one or more sensors described previously and with reference to FIGS. 1A-1D. The input(s) 410 can correspond to the identifier(s) described previously and with reference to step 302 of the method 300. In at least some embodiments, for example, the inputs 410 include one or more of the following: a moldboard sideshift identifier 410*a*, a left moldboard lift identifier 410*b*, a right moldboard lift identifier 410*c*, a circle rotation identifier 410*d*, a drawbar centershift identifier 410*e*, a linkbar position identifier 410*f*, a frame articulation identifier 410*g*, a wing position identifier 410*h*, a machine mode identifier 410*i*, and/or any other suitable identifier.

The system 400 can further include a moldboard controller 420. The moldboard controller 420 can be configured to perform one or more steps of the method 300. In at least some embodiments, for example, the moldboard controller 420 can receive one or more identifiers corresponding to a configuration of a machine (e.g., step 302). In at least some embodiments, for example, the moldboard controller 420 can determine a first orientation of the moldboard relative to the wing (e.g., step 304), e.g., based on the input(s) 410. In at least some embodiments, for example, the moldboard controller 420 can determine whether the first orientation is within an operating threshold (e.g., step 306).

The system 400 can further include one or more actuators 430. The actuator(s) 430 can be coupled (e.g., operatively, communicatively, etc.) to the moldboard controller 420. The actuator(s) 430 can include any of the moldboard actuators and/or wing actuators described previously. In at least some embodiments, for example, the actuator(s) 430 can include one or more of the following: (i) the moldboard lateral or sideshift actuator 124; (ii) the second (e.g., left) circle tilt or moldboard lift actuator 122*b*; (iii) the first (e.g., right) circle tilt or moldboard lift actuator 122*a*; (iv) the circle motor or rotation actuator 118; (v) the drawbar centershift actuator 120; (vi) the linkbar actuator 128; (vii) the front frame articulation element 140; (viii) the wing tilt actuator 136; (ix) the wing mast actuator 138; and/or any other actuator described herein. Accordingly, in some embodiments, the moldboard controller 420 can be configured to select and/or actuate one or more of the actuators 430, e.g., to transition the moldboard from a first orientation to a second orientation (e.g., step 308).

It is expected that machines and/or systems configured in accordance with embodiments of the present technology represent an improvement over traditional machines and/or systems. For example, when the moldboard 112 is within the operating threshold, it is expected that the machine 100 will remove material from a surface with greater efficiency. This is expected to improve productivity, reduce wear on the machine 100, the moldboard edge 113, and/or the wing edge 133, as well as improve the fuel efficiency of the machine compared to traditional machines and/or systems.

The techniques disclosed herein can be embodied as special-purpose hardware (e.g., circuitry), as programmable circuitry appropriately programmed with software and/or firmware, or as a combination of special-purpose and programmable circuitry. Hence, embodiments may include a machine-readable medium having stored thereon instructions which may be used to cause a computer, a microprocessor, processor, and/or microcontroller (or other electronic devices) to perform a process. The machine-readable medium may include, but is not limited to, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions.

Figure 5:
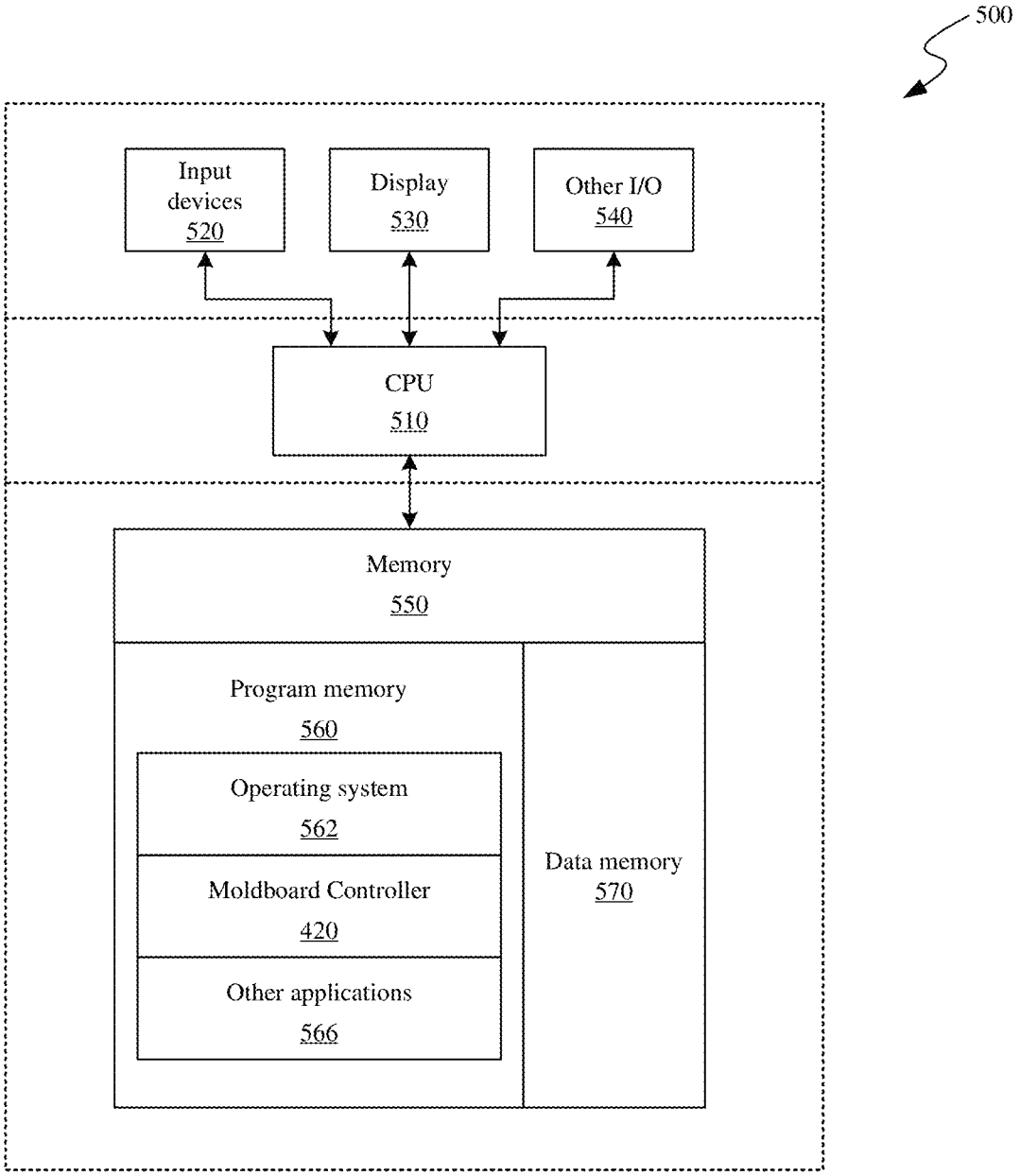
FIG. 5 is a block diagram illustrating an overview of devices on which some implementations can operate.

Several implementations are discussed below in more detail in reference to the figures. FIG. 5 is a block diagram illustrating an overview of devices on which some implementations of the disclosed technology can operate. The devices can comprise hardware components of a system or device 500 that can position a moldboard, for example. Device 500 can include one or more input devices 520 that provide input to the CPU (processor) 510, notifying it of actions. The actions are typically mediated by a hardware controller that interprets the signals received from the input device and communicates the information to the CPU 510 using a communication protocol. Input devices 520 include, for example, a mouse, a keyboard, a touchscreen, an infrared sensor, a touchpad, a wearable input device, a camera- or image-based input device, a microphone, or other user input devices.

CPU 510 can be a single processing unit or multiple processing units in a device or distributed across multiple devices. CPU 510 can be coupled to other hardware devices, for example, with the use of a bus, such as a PCI bus or SCSI bus. The CPU 510 can communicate with a hardware controller for devices, such as for a display 530. Display 530 can be used to display text and graphics. In some examples, display 530 provides graphical and textual visual feedback to a user. In some implementations, display 530 includes the input device as part of the display, such as when the input device is a touchscreen or is equipped with an eye direction monitoring system. In some implementations, the display is separate from the input device. Examples of display devices are: an LCD display screen; an LED display screen; a projected, holographic, or augmented reality display (such as a heads-up display device or a head-mounted device); and so on. Other I/O devices 540 can also be coupled to the processor, such as a network card, video card, audio card, USB, FireWire or other external device, sensor, camera, printer, speakers, CD-ROM drive, DVD drive, disk drive, or Blu-Ray device.

In some implementations, the device 500 also includes a communication device capable of communicating wirelessly or wire-based with a network node. The communication device can communicate with another device or a server through a network using, for example, TCP/IP protocols. Device 500 can utilize the communication device to distribute operations across multiple network devices.

The CPU 510 can have access to a memory 550. A memory includes one or more of various hardware devices for volatile and non-volatile storage, and can include both read-only and writable memory. For example, a memory can comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. A memory is not a propagating signal divorced from underlying hardware; a memory is thus non-transitory. Memory 550 can include program memory 560 that stores programs and software, such as an operating system 562, Moldboard Controller 420 (which may include instructions for carrying out the methods of automatic moldboard positioning disclosed herein), and other application programs 566. Memory 550 can also include data memory 570 that can include database information, etc., which can be provided to the program memory 560 or any element of the device 500.

Some implementations can be operational with numerous other general purpose or special purpose computing system environments or configurations. Examples of well-known computing systems, environments, and/or configurations that may be suitable for use with the technology include, but are not limited to, personal computers, server computers, handheld or laptop devices, cellular telephones, mobile phones, wearable electronics, gaming consoles, tablet devices, multiprocessor systems, microprocessor-based systems, set-top boxes, programmable consumer electronics, network PCs, minicomputers, mainframe computers, distributed computing environments that include any of the above systems or devices, or the like.

Figure 6:
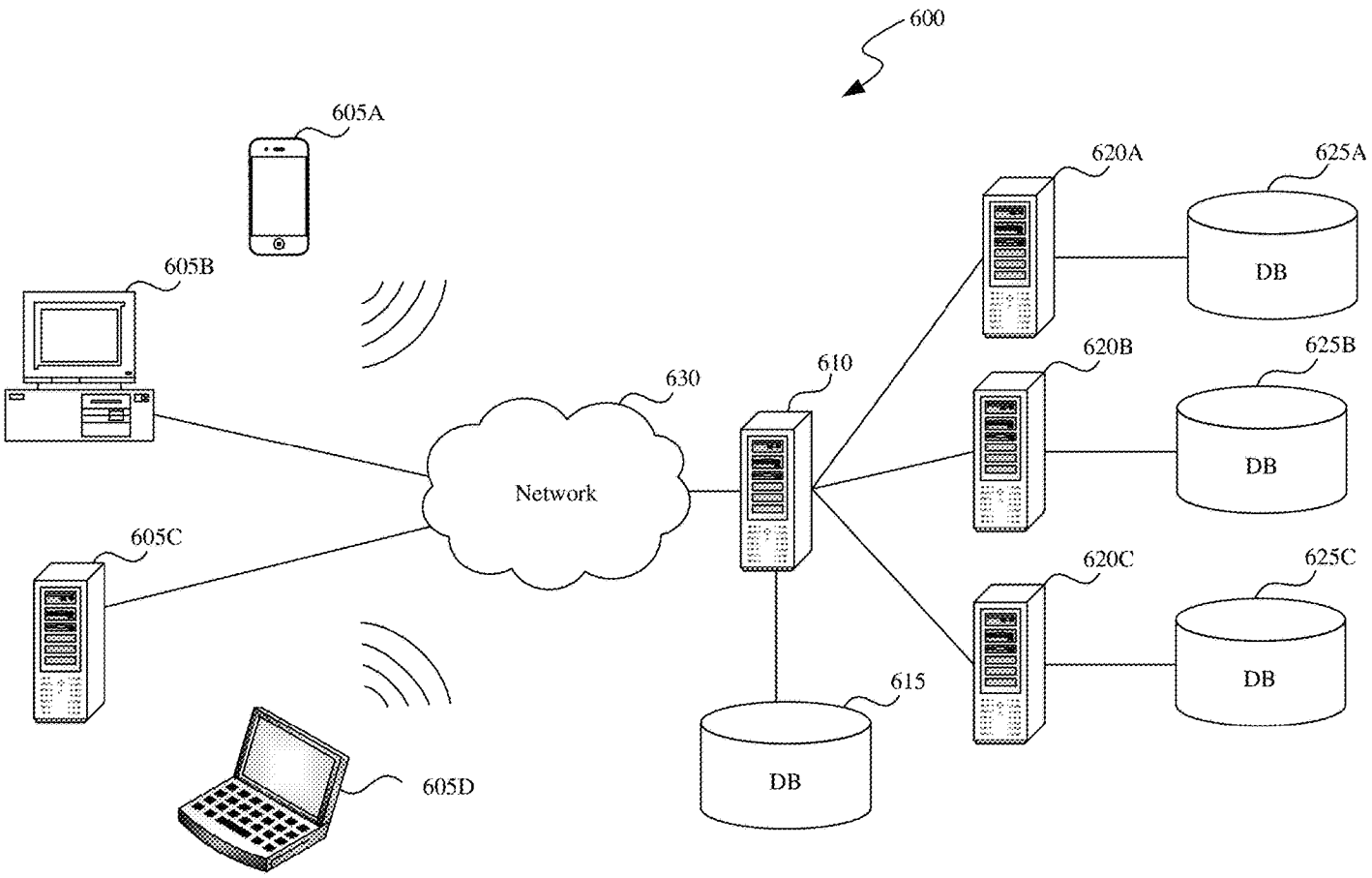
FIG. 6 is a block diagram illustrating an overview of an environment in which some implementations can operate.

FIG. 6 is a block diagram illustrating an overview of an environment 600 in which some implementations of the disclosed technology can operate. Environment 600 can include one or more client computing devices 605A-D, examples of which can include device 500. Client computing devices 605 can operate in a networked environment using logical connections through network 630 to one or more remote computers, such as a server computing device 610.

In some implementations, server computing device 610 can be an edge server that receives client requests and coordinates fulfillment of those requests through other servers, such as servers 620A-C. Server computing devices 610 and 620 can comprise computing systems, such as device 500. Though each server computing device 610 and 620 is displayed logically as a single server, server computing devices can each be a distributed computing environment encompassing multiple computing devices located at the same or at geographically disparate physical locations. In some implementations, each server computing device 620 corresponds to a group of servers.

Client computing devices 605 and server computing devices 610 and 620 can each act as a server or client to other server/client devices. Server 610 can connect to a database 615. Servers 620A-C can each connect to a corresponding database 625A-C. As discussed above, each server 620 can correspond to a group of servers, and each of these servers can share a database or can have their own database. Databases 615 and 625 can warehouse (e.g., store) information. Though databases 615 and 625 are displayed logically as single units, databases 615 and 625 can each be a distributed computing environment encompassing multiple computing devices, can be located within their corresponding server, or can be located at the same or at geographically disparate physical locations.

Network 630 can be a local area network (LAN) or a wide area network (WAN), but can also be other wired or wireless networks. Network 630 may be the Internet or some other public or private network. Client computing devices 605 can be connected to network 630 through a network interface, such as by wired or wireless communication. While the connections between server 610 and servers 620 are shown as separate connections, these connections can be any kind of local, wide area, wired, or wireless network, including network 630 or a separate public or private network.

Figure 7:
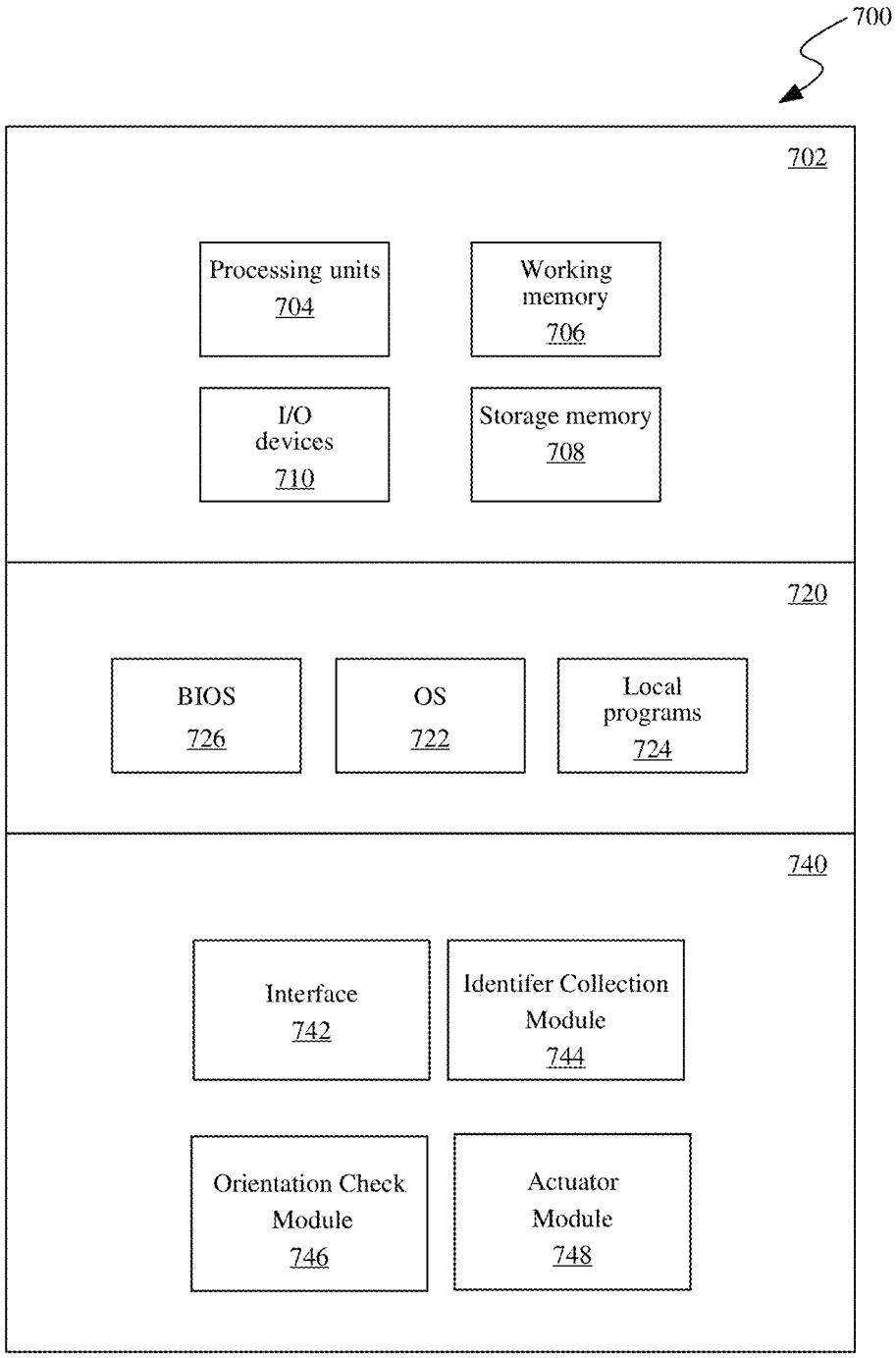
FIG. 7 is a block diagram illustrating elements which, in some implementations, can be used in a system employing the disclosed technology.

FIG. 7 is a block diagram illustrating elements 700 which, in some implementations, can be used in a system employing the disclosed technology. The elements 700 include hardware 702, general software 720, and specialized elements 740. As discussed above, a system implementing the disclosed technology can use various hardware, including processing units 704 (e.g., CPUs, GPUs, APUs, etc.), working memory 706, storage memory 708, and input and output devices 710. Elements 700 can be implemented in a client computing device such as client computing devices 605 or on a server computing device, such as server computing device 610 or 620.

General software 720 can include various applications, including an operating system 722, local programs 724, and a basic input output system (BIOS) 726. Specialized elements 740 can be subcomponents of a general software application 720, such as local programs 724, which may include the Moldboard Controller 420 (see FIG. 4 and description above). Specialized elements 740 can include an Identifier Collection Module 744, an Orientation Check Module 746, and an Actuator Module 748, and components that can be used for transferring data and controlling the specialized components, such as interface 742. In some implementations, elements 700 can be in a computing system that is distributed across multiple computing devices or can be an interface to a server-based application executing one or more of specialized elements 740.

Those skilled in the art will appreciate that the components illustrated in FIGS. 5-7 described above, and in each of the flow diagrams discussed above, may be altered in a variety of ways. For example, the order of the logic may be rearranged, sub steps may be performed in parallel, illustrated logic may be omitted, other logic may be included, etc. In some implementations, one or more of the components described above can execute one or more of the processes described herein.

INDUSTRIAL APPLICABILITY

In some embodiments, systems for automatic moldboard positioning can include an Identifier Collection Module 744, an Orientation Check Module 746, and an Actuator Module 748 (FIG. 7).

In operation, the Identifier Collection Module 744 can collect and store the one or more identifiers (see step 302 in FIG. 3). The Orientation Check Module 746 can determine the orientation of the moldboard relative to the wing (see step 304 in FIG. 3). The Orientation Check Module 746 can additionally determine whether the first orientation of the moldboard is within the operating threshold (see step 306 in FIG. 3). If the first orientation, as determined by the Orientation Check Module 746, is not within the operating threshold, the Actuator Module 748 can select and actuate one or more actuators to move the moldboard from the first orientation to the second orientation within the operating threshold (see step 308 of FIG. 3).

General software 720 (see FIG. 7) may include instructions to repeat steps 302, 304, 306 and/or step 308 of the method 300 (see FIG. 3) at selected increments of time to continually or periodically update the identifiers and/or the orientation of the moldboard. In some embodiments, the method 300 may include repeating steps 302, 304, 306, 308, and/or other steps based on a determination of an identifier correspond to a change in orientation of the moldboard, such as the frame articulation identifier 410*g*.

The disclosed technology, therefore, provides automatic positioning of a moldboard, and can thereby increase the efficiency (e.g., operating efficiency) of a machine. In particular, the disclosed technology can adjust the orientation of the moldboard to correspond with or match the orientation of the wing based on an operating threshold, which is expected to reduce wear on the machine, the moldboard edge, and/or the wing edge, as well as improve the fuel efficiency of the machine.

REMARKS

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" (or the like) in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the claims are not to be limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

As used herein, the term "and/or" when used in the phrase "A and/or B" means "A, or B, or both A and B." A similar manner of interpretation applies to the term "and/or" when used in a list of more than two terms.

The above detailed description of embodiments of the technology are not intended to be exhaustive or to limit the technology to the precise forms disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. Additionally, the term "comprising" is used throughout to mean including at least the recited feature(s) such that any greater number of the same feature and/or additional types of other features are not precluded, unless context suggests otherwise. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

What is claimed is:

1. A computer-implemented method for automatically adjusting a moldboard of a motor grader, the method comprising:

receiving one or more identifiers corresponding to a configuration of the motor grader, wherein the motor grader comprises:

a rear frame, a front frame pivotably coupled to the rear frame, a moldboard assembly coupled to the front frame, the moldboard assembly including the moldboard, a drawbar, a circle, and a plurality of actuators each operably coupled to at least one of the moldboard, the drawbar, and the circle, and a wing assembly coupled to the rear frame and to the front frame, the wing assembly including a wing;

determining, based on the one or more identifiers, a first orientation of the moldboard relative to the wing; and if the first orientation is not within an operating threshold:

selecting, based on the one or more identifiers, at least one of the plurality of actuators, and actuating the selected actuator to move the moldboard from the first orientation to a second orientation relative to the wing, wherein the second orientation is within the operating threshold.

2. The method of claim 1 wherein:

the moldboard includes a moldboard cutting edge extending along a first axis;

the wing includes a wing cutting edge extending along a second axis; and determining the first orientation of the moldboard includes determining an angle between the first axis and the second axis.

3. The method of claim 2 wherein:

the operating threshold includes an angle relative to the second axis of up to 1 degree, up to 2 degrees, up to 3 degrees, up to 4 degrees, up to 5 degrees, up to 10 degrees, or up to 20 degrees; and in the second orientation, the first axis is within the operating threshold of the second axis.

4. The method of claim 1 wherein the configuration of the motor grader is a first configuration, the at least one actuator is a first actuator, and the one or more identifiers are one or more first identifiers, the method further comprising:

receiving one or more second identifiers wherein:

the second identifiers correspond to transitioning the motor grader from the first configuration to a second configuration, and transitioning the motor grader to the second configuration includes moving the moldboard from the first or second orientation to a third orientation relative to the wing; and if the third orientation is not within the operating threshold:

selecting, based on the one or more second identifiers, at least one second actuator of the plurality of actuators, and actuating the selected second actuator to move the moldboard from the third orientation to a fourth orientation, wherein the fourth orientation is within the operating threshold.

5. The method of claim 4 wherein transitioning the motor grader from the first configuration to the second configuration includes pivoting the front frame relative to the rear frame.

6. The method of claim 1 wherein:

the moldboard has a first end portion having a first profile;

the wing has a second end portion having a second profile, the second end portion being proximate to the first end portion; and in the second orientation, the first profile is within the operating threshold of the second profile.

7. The method of claim 1 wherein the one or more identifiers include at least one of:

(i) a moldboard sideshift identifier, (ii) a moldboard left lift identifier, (iii) a moldboard right lift identifier, (iv) a circle rotation identifier, (v) a drawbar centershift identifier, (vi) a linkbar pin position identifier, (vii) a frame articulation identifier, (viii) a wing position identifier, and/or (ix) a motor grader mode identifier.

8. The method of claim 1 wherein the plurality of actuators includes at least one of:

(i) a moldboard sideshift actuator, (ii) a moldboard left lift actuator, (iii) a moldboard right lift actuator, (iv) a circle rotation actuator, (v) a drawbar centershift actuator, (vi) a linkbar pin position actuator, (vii) a frame articulation actuator, (viii) a wing tilt actuator, and/or (ix) a wing mast actuator.

9. The method of claim 1 wherein the wing assembly includes a plurality of wing actuators operably coupled to the wing, the method further comprising:

determining, based on the one or more identifiers, a third orientation of the wing;

identifying, based on the one or more identifiers, at least one of the plurality of wing actuators, and actuating the at least one wing actuator to move the wing from the third orientation to a fourth orientation.

10. The method of claim 9 wherein the plurality of wing actuators includes at least one of:

(i) a wing tilt actuator;

(ii) a wing mast actuator; and/or (iii) a wing brace actuator.

11. The method of claim 1 wherein:

the wing includes a wing end portion proximate the moldboard, the moldboard includes a moldboard end portion proximate the wing, the operating threshold is a distance from the wing end portion to an edge of the moldboard of up to 1 mm, up to 2 mm, up to 3 mm, up to 4 mm, up to 5 mm, up to 10 mm, up to 20 mm, up to 30 mm, up to 40 mm, up to 50 mm, up to 100 mm, up to 200 mm, up to 300 mm, up to 400 mm, or up to 500 mm, and in the second orientation, the moldboard end portion is within the operating threshold of the wing end portion.

12. A system for automatically adjusting a moldboard of a motor grader, the system comprising:

one or more processors; and one or more memory devices having stored thereon instructions that when executed by the one or more processors cause the one or more processors to:

receive one or more identifiers corresponding to a configuration of the motor grader, wherein the motor grader comprises:

a rear frame, a front frame pivotably coupled to the rear frame, a moldboard assembly coupled to the front frame, the moldboard assembly including the moldboard, a drawbar, a circle, and a plurality of actuators each operably coupled to at least one of the moldboard, the drawbar, and the circle, and a wing assembly coupled to the rear frame and to the front frame, the wing assembly including a wing;

determine, based on the one or more identifiers, a first orientation of the moldboard relative to the wing; and if the first orientation is not within an operating threshold:

select, based on the one or more identifiers, at least one of the plurality of actuators, and actuate the selected actuator to move the moldboard from the first orientation to a second orientation relative to the wing, wherein the second orientation is within the operating threshold.

13. The system of claim 12 wherein:

the moldboard includes a moldboard cutting edge extending along a first axis;

the wing includes a wing cutting edge extending along a second axis; and determining the first orientation of the moldboard includes determining an angle between the first axis and the second axis.

14. The system of claim 13 wherein:

the operating threshold includes an angle relative to the second axis of up to 1 degree, up to 2 degrees, up to 3 degrees, up to 4 degrees, up to 5 degrees, up to 10 degrees, or up to 20 degrees; and in the second orientation, the first axis is within the operating threshold of the second axis.

15. The system of claim 12 wherein the configuration of the motor grader is a first configuration, the at least one actuator is at least one first actuator, and the one or more identifiers are one or more first identifiers, the method further comprising:

receiving one or more second identifiers wherein:

the second identifiers correspond to transitioning the motor grader from the first configuration to a second configuration, and transitioning the motor grader to the second configuration includes moving the moldboard from the first or second orientation to a third orientation relative to the wing; and if the third orientation is not within the operating threshold:

identifying, based on the one or more second identifiers, at least one second actuator of the plurality of actuators, and actuating the second actuator to move the moldboard from the third orientation to a fourth orientation, wherein the fourth orientation is within the operating threshold.

16. The system of claim 15 wherein transitioning the motor grader from the first configuration to the second configuration includes pivoting the front frame relative to the rear frame.

17. An apparatus for automatically adjusting a moldboard, the apparatus comprising:

a motor grader comprising:

a rear frame, a front frame pivotably coupled to the rear frame, a moldboard assembly coupled to the front frame, the moldboard assembly including the moldboard, a drawbar, a circle, and a plurality of actuators each operably coupled to at least one of the moldboard, the drawbar, and the circle, and a wing assembly coupled to the rear frame and to the front frame, the wing assembly including a wing, and one or more sensors configured to determine a configuration of the motor grader; and one or more non-transitory computer-readable media storing computer-executable instructions that, when executed by one or more processors, cause the one or more processors to perform operations comprising:

receive, via a controller communicatively coupled to the one or more sensors, one or more identifiers corresponding to a configuration of the motor grader;

determine, via the controller and based at least in part on the one or more identifiers, a first orientation of the moldboard relative to the wing; and if the first orientation is not within an operating threshold:

select, based on the one or more identifiers, at least one of the plurality of actuators, and actuate the selected actuator to move the moldboard from the first orientation to a second orientation relative to the wing, wherein the second orientation is within the operating threshold.

18. The apparatus of claim 17 wherein:

the moldboard includes a moldboard cutting edge extending along a first axis;

the wing includes a wing cutting edge extending along a second axis; and the determining the first orientation of the moldboard includes determining an angle between the first axis and the second axis.

19. The apparatus of claim 18 wherein:

the operating threshold includes angle relative to the second axis of up to 1 degree, up to 2 degrees, up to 3 degrees, up to 4 degrees, up to 5 degrees, up to 10 degrees, or up to 20 degrees; and in the second orientation, the first axis is within the operating threshold of the second axis.

20. The apparatus of claim 17 wherein the configuration of the motor grader is a first configuration, the at least one actuator is a first actuator, and the one or more identifiers are one or more first identifiers, the method further comprising:

receiving one or more second identifiers wherein:

the second identifiers correspond to transitioning the motor grader from the first configuration to a second configuration, and transitioning the motor grader to the second configuration includes moving the moldboard from the first or second orientation to a third orientation relative to the wing; and if the third orientation is not within the operating threshold:

identifying, based on the one or more second identifiers, at least one second actuator of the plurality of actuators, and actuating the second actuator to move the moldboard from the third orientation to a fourth orientation, wherein the fourth orientation is within the operating threshold.

* * * * *